US005531543A

United States Patent [19]

Johnsen

[11] Patent Number: 5,531,543

[45] Date of Patent: Jul. 2, 1996

[54] DEVICE FOR ENSURING FREE WATER PASSAGE TO ROOF RAINWATER OUTLETS IN CONNECTION WITH ICE FORMATION

[76] Inventor: Asle Johnsen, Bjørnsonsvei 13, N-3100, Tønsberg, Norway

[21] Appl. No.: 362,536

[22] PCT Filed: Jul. 7, 1993

[86] PCT No.: PCT/NO93/00110

§ 371 Date: Mar. 7, 1995

§ 371 Date: Mar. 7, 1995

§ 102(e) Date: WO94/01637

[87] PCT Pub. No.: Jan. 20, 1994

[30] Foreign Application Priority Data

Jul. 8, 1992 [NO] Norway ..... 922688

[51] Int. Cl.[6] ..... E04D 13/04; E04D 13/064

[52] U.S. Cl. ..... 405/37; 52/11; 219/213

[58] Field of Search ..... 52/11; 219/213, 219/538, 201; 405/36, 52, 37

[56] References Cited

U.S. PATENT DOCUMENTS

| | | | |
|---|---|---|---|
| 2,111,251 | 3/1938 | Spilsbury | 52/11 X |
| 3,725,638 | 4/1973 | Solin et al. | 219/213 |

FOREIGN PATENT DOCUMENTS

| | | |
|---|---|---|
| 1272240 | 7/1968 | Germany . |
| 1708980 | 5/1971 | Germany . |
| 2006312 | 8/1971 | Germany . |
| 212369 | 2/1941 | Switzerland . |
| 8903465 | 4/1989 | WIPO . |

*Primary Examiner*—Stephen J. Novosad
*Attorney, Agent, or Firm*—Harness, Dickey & Pierce

[57] ABSTRACT

A device for ensuring free flow to roof rainwater outlets, especially on flat roofs, in connection with ice formation. The device comprises a feed means (1) in the form of at least one channel member (2) extending outwards from a gully (4) and being provided with a plurality of side inlet openings (6) along its length, and a heating cable (11) arranged within the channel member (2) and which is arranged to be thermostatically connected within a chosen temperature interval, to melt ice which has formed around the gully (4). The temperature interval of the thermostat suitably is ca. 2° C. and this interval preferably is displaceable within a chosen temperature range, e.g. between −5° C. and 0° C. Alternatively, the thermostat records the surface temperature of the roof covering and connects the heating cable (11) when the temperature rises and passes 0° C. whereafter the heating cable is switched off with a cycle timer so that it is switched on only in the period which is necessary for melting a hole in the ice barrier.

13 Claims, 2 Drawing Sheets

DEVICE FOR ENSURING FREE WATER PASSAGE TO ROOF RAINWATER OUTLETS IN CONNECTION WITH ICE FORMATION

The invention relates to a device for ensuring free flow to roof rainwater outlets, especially on flat roofs, in connection with ice formation, comprising a heating cable in the form of at least one loop extending a distance outwards from a gully on the surface of the roof.

At gully or outlet openings in flat roofs, hot air ascends from the drain system, and in the winter this hot air will melt snow lying on the roof close to the gully. When the air temperature at the roof surface sinks below 0° C., the melting water freezes so that, after some time, a rough sheet of ice is formed in a ring around the gully. This ice sheet prevents passage of the melting water forwards to the gully, and this may result in that large roof faces are put under water when the snow on the roof melts. Because of the large weight of the water, in such cases there often arise water leakages, with resulting great internal damages in the buildings in question.

Various devices are known for solving the problem with ice formation in connection with roof rainwater outlets on flat roofs. A device of the introductorily stated type for example is known from the Swedish laying-open print No. 386 939. It is stated therein that heating loops may be laid out along the roof surface, e.g. in the form of a cross, and that the heating loops melt holes in the ice wall and thereby enables drainage of melting water which has been formed outside the ice wall.

In the known device according to said publication, the heating loops are shown to lie directly on the roof, and are without any form for protection. This will be a vulnerable arrangement which in practice may easily be subjected to damage because of external influence. Further, the heating cables themselves may contribute to causing an obstacle to the passage of the water forwards to the gully, since leaves, twigs and other rubbish may collect around the cables.

The main objective of the present invention is to provide a device which, in an efficient and safe manner, prevents that large roof surfaces are put under water when the snow on the roof melts.

A more particular object of the invention is to provide such a device constituting a closed system which ensures protection of the heating cables as well as ensures free flow of the water to the gully over a relatively large influx area.

An additional object of the invention is to provide such a device which enables current supply to the heating cables from the interior of the device, via the downpipe of the gully.

The above-mentioned objects are achieved with a device of the introductorily stated type which, according to the invention, is characterized in that it comprises a feed means in the form of at least one channel member extending outwards from the gully and being provided with a plurality of side inlet openings along its length, and that the heating cable is arranged within the channel member and is arranged to be thermostatically connected within a chosen temperature interval, to melt ice which has formed around the gully.

The invention will be further described below in connection with an exemplary embodiment with reference to the drawings, wherein, FIG. 1 shows a plan view of a device according to the invention;

Figure 1:
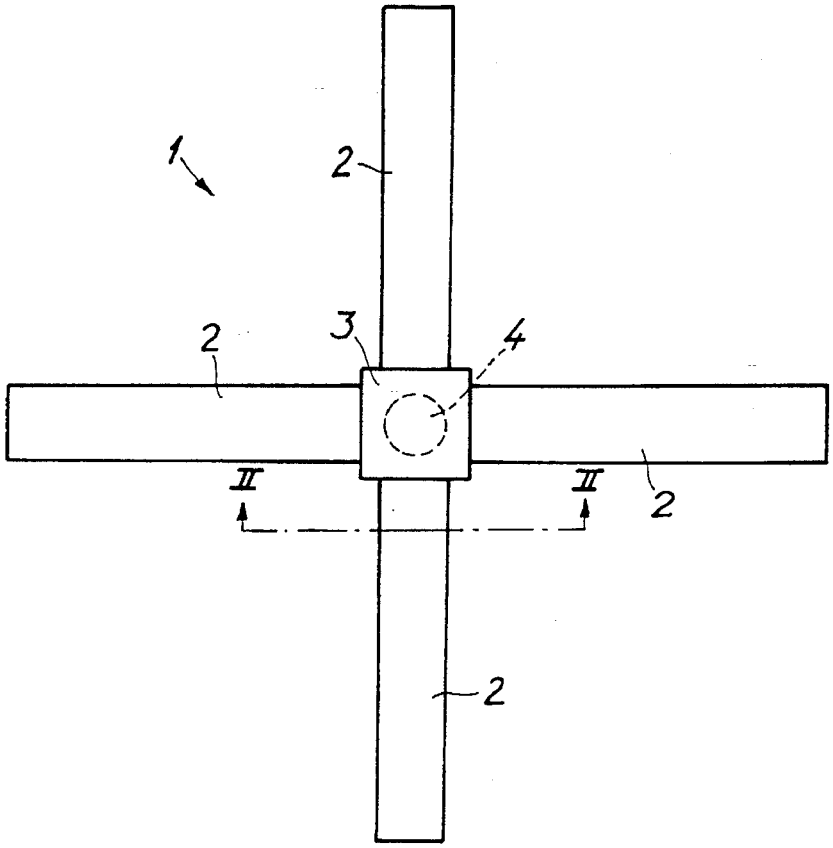

In the embodiment shown in FIG. 1 the device according to the invention comprises an inflow or feed means 1 consisting of four channel members 2 arranged in star shape and extending radially outwards from a centre member 3 which, in use, will be installed over and cover the topical gully 4. It will be clear that the feed means in practice will consist of at least one channel member, and that several channel members may be arranged in the most suitable manner in the topical case. The channel members at least must be so long that they extend outside the ice formation region in the topical case.

Figure 2:
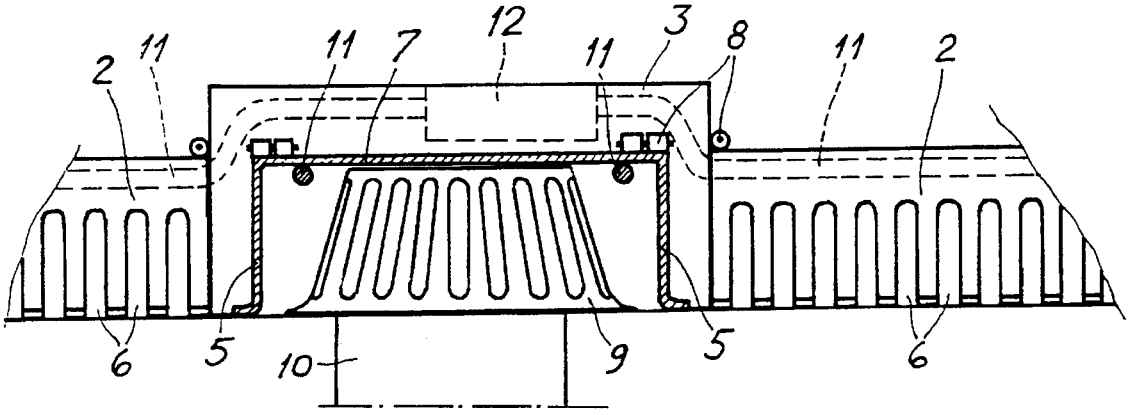
FIG. 2 shows a sectional view along the line II—II in FIG. 1.

The channel members suitably have an inverted U-shaped cross-section, so that they are closed at the top and has an open bottom, as shown in FIG. 2. The side walls 5 of the channel member, possibly including the outer end wall, are provided with relatively closely spaced, downwardly open inlet slots 6 extending upwards towards the upper side or roof 2 of the channel member. Thereby a relatively large influx area for flow of water to the gully is obtained.

The centre member 3 consists of an inverted, square box of which the side walls have cut-outs fitting the cross-section of the channel members. The channel members 2 are hinged to the centre member 3 by means of hinges 8, as shown in FIG. 2, so that the channel members may adjust themselves in accordance with the topical slope of the roof towards the gully 4. The centre member 3 is suitably dimensioned to cover the perforated gully cap 9 which will normally be arranged above the downpipe 10 of the gully.

Figure 3:
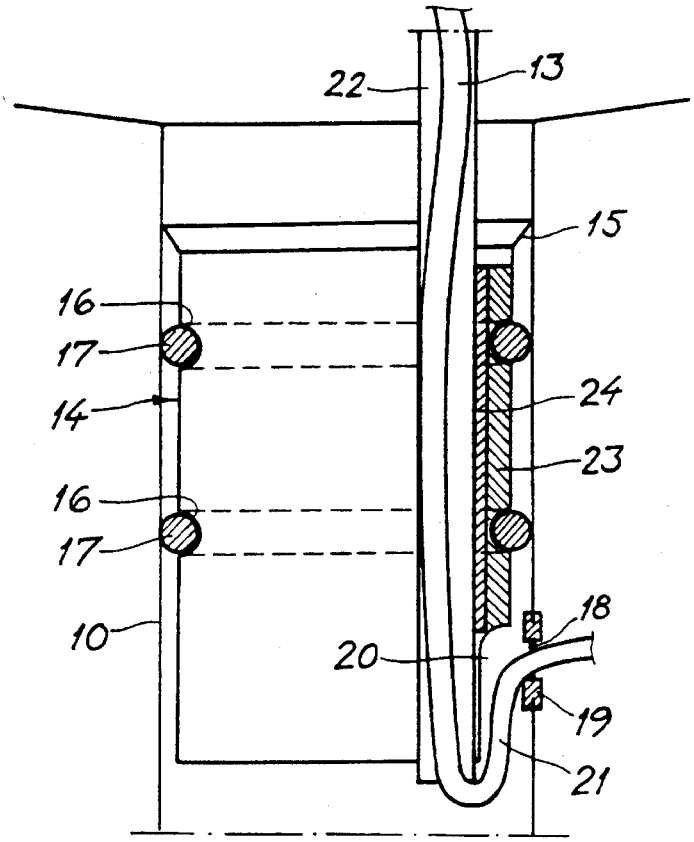
FIG. 3 shows a longitudinal section of a lead-in socket for a current supply cable via a downpipe from a gully.
Figure 4:
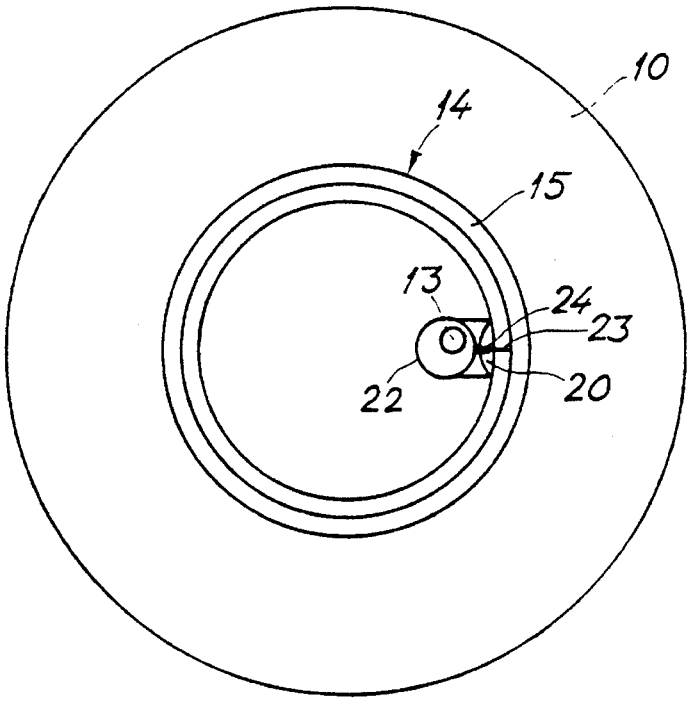
FIG. 4 shows a view of the device in FIG. 3 as viewed from above.

Within each of the channel members 2 there is arranged a heating cable 11 which suitably is fastened to the upper side (or roof) of the channel member, as suggested in FIG. 4. The heating cables 11 are connected to terminals in a connection box 12 which, in the illustrated embodiment, is fastened under the roof of the centre member 3, and wherein there is also connected a current supply cable 13 (only shown in FIGS. 3 and 4) which is carried into the centre member 3 via the downpipe 10 by means of the arrangement shown in FIGS. 3 and 4.

The current supply to the heating cables 11 is controlled by means of a thermostat (not shown) which connects the current within a chosen temperature interval which suitably may be ca. 2° C. When the temperature at the roof surface is equal to or approximately equal to the ambient air temperature, said temperature interval will extend from −1° C. to +1° C., so that the heating cables are connected approximately 1° below the melting point (0° C.). In order to get a safe system, it is essential that the heating cables are connected just before melting of the snow on the roof takes place, so that a passage is provided for the water through the ice formation or ice barrier in the channel members before substantial quantities of melting water is collected on the roof.

Because of varying roof insulation on different buildings, the temperature at the roof surface will vary from case to case, so that it may be more or less above the ambient air temperature because of the heat from the roof. In order to take this circumstance into account, the thermostat preferably is of a type wherein the connecting temperature may be displaced within a chosen temperature range, e.g. between −5° C. and +1° C., so that the thermostat connects the heating cables just before melting of the snow on the roof starts.

Alternatively, the thermostat may be controlled by a temperature sensor sensing the surface temperature of the roof surface. When the temperature at the roof surface rises, the heating cables will be connected at 0° C. (possibly somewhat below). The thermostat simultaneously starts a cycle timer which disconnects the heating cables after a hole having been melted in the ice barrier.

The thermostat will be placed at a suitable place in association with the device. It may also be placed at a suitable place to control the connection of several such devices in parallel. The thermostat and its circuit means for control of the current supply is not further shown, since it will be known to a person skilled in the art.

An arrangement for introduction of the current supply cable 13 into the centre member 3 via the downpipe 10 of the gully, that is, so that one does not have to wire current cables over the roof surface, is shown in FIGS. 3 and 4. The arrangement comprises a lead-in socket 14 consisting of a cylindrical tube length having a diameter which is somewhat smaller than the diameter of the downpipe, and which is shaped such that it forms a sealing abutment against the inner side of the downpipe 10 when the socket is introduced therein. Thus, the socket at its upper end is provided with a somewhat yielding sealing flange 15, and in addition is provided with a pair of peripheral ring grooves 16 for receiving respective sealing rings 17 bearing against the inner wall of the downpipe 10. Thereby it is ensured that the water from the gully passes through the socket and is prevented from passing between the socket and the inner wall of the tube.

The supply cable 13 is carried through a hole 18 formed in the wall of a downpipe at the lower end of the socket, and more specifically is carried through a cable-protecting rubber gasket 19 which is sealingly placed in the hole. Further, the socket at its lower end is proved with a chute-shaped or part-cylindrical recess 20 having a diameter which is 10–15 mm larger than the diameter of the cable, for receiving a portion 21 of the cable extending a distance downwards from the hole 18 in the tube wall. The purpose of the recess 20 is to make room for the cable 13 at the inside of the hole, and to see to it that the cable is given a shape forming a "drip nose", so that water following the cable will drip off and not be able to follow the cable through the wall of the downpipe 10 and into the building in question.

The lead-in socket 14 also comprises a longitudinally extending tube 22 receiving and protecting the current supply cable 13. The tube 22 is kept in place by the socket, and for this purpose the socket is provided with a combined guiding and fastening means for the tube vertically above the recess 20. This means is shown to consist of a guide rail 23 which is fastened to the socket wall and is in slidable engagement in a corresponding guide channel 24 extending along and being fastened to the tube 22.

When installing the lead-in socket 14, this is slid onto the cable 13 after the cable has been carried through the hole 18 formed in the tube wall and has been pulled up through the downpipe 10 and onto the roof. The socket is slid so far into the downpipe that the lower end of the socket passes the hole 18, so that the recess 20 of the socket stops against the current supply cable 13. Thereafter, the protecting tube 22 is slid onto the cable, and the guide channel 24 is brought into engagement with the guide rail 23 and is moved downwards therealong until the lower end of the protecting tube stops at the lower end of so the lead-in socket. Thereafter the protecting tube is cut at a suitable height above the roof, and the installation is finished.

Parallel with the current supply cable 13 there may also be carried forward supply lines for current to the thermostat and the control circuit means thereof, when the latter e.g. is placed in the connection box 12. Possibly there may also be carried forward a supply line for a water sensor (not shown) which may be mounted on the wall of one of the channel members 2, to record an inadmissibly high water level on the roof, if this should occur because of some fault.

The lead-in socket, with its protecting tube and guide means, advantageously may be made of plastics. The same is the case with the channel members and the centre member.

The lead-in socket may also be contemplated to be used in other fields where there is a need for a similar lead-in socket for carrying forward cables or the like.

I claim:

1. A device for ensuring free flow of water to roof rainwater outlets, especially on flat roofs, in connection with ice formation, comprising:

a feed means in the form of at least one channel member extending outwards from a gully on the roof surface and being provided with a plurality of side inlet openings along its length;

a heating cable disposed within said channel member, and being connected in an electric circuit for supply of current thereto;

a thermostat connected in said electric circuit for connecting said heating cable to said supply of current;

a temperature sensor mounted at the roof surface for sensing the roof surface temperature, and actuating said thermostat so as to connect the heating cable at a temperature of approximately 0° C.; and a cycle timer connected in said electric circuit and being started by said thermostat at said temperature, the cycle timer disconnecting the heating cable from said supply of current after a chosen time period.

2. A device according to claim 1, wherein said feed means comprises four channel members which are arranged in star shape each extending outwardly from said gully.

3. A device according to claims 1 or 2, wherein said channel member or channel members is/are closed at the top and has/have side walls which are provided along their entire length with closely spaced inlet slots extending upwards from the bottom of the channel member.

4. A device according to claim 2, wherein said channel members at their inner end are hinged to a centre member surrounding the gully.

5. A device according to claim 1, comprising a lead-in socket to be sealingly placed in a downpipe from said gully, to carry a current supply cable of said electric circuit forwards to said heating cable via the downpipe, the supply cable being carried through a hole in the wall of said downpipe at the lower end of said socket, and the socket being provided with a sealing means preventing water leakage from said downpipe via said hole.

6. A device according to claim 5, wherein said socket consists of a cylindrical tube length having a diameter which is somewhat smaller than the diameter of said downpipe, the wall of the socket being provided with at least one ring groove for receiving a sealing ring for sealing against said downpipe, and wherein said pocket at its lower end is provided with a chute-shaped recess for receiving a portion of the current supply cable extending a distance downwards from said hole.

7. A device according to claim 6, wherein said socket above said recess is provided with a combined guiding and fastening means for a protecting tube for said current supply cable, so that the protecting tube may be moved onto the cable and by means of said guiding means may be displaced downwards until it stops against the supply cable where this is bent upwards from said recess at the lower end of said socket.

8. A device according to claim 7, wherein said guiding means consists of a guide rail for slidable engagement in a corresponding guide channel fastened to said protecting tube.

9. A device for ensuring free flow to roof rainwater outlets, especially on flat roofs, in connection with ice formation, comprising:

a feed means comprising four channel members arranged in star shape extending outwardly from said gully;

a heating cable disposed within each of said channel members and being connected in an electric circuit for supply of current thereto;

a thermostat connected in said electric circuit for connecting said heating cables to said current supply;

a temperature sensor mounted at the roof surface for sensing the roof surface temperature, and actuating said thermostat so as to connect the heating cables to said current supply at a temperature of approximately 0° C.; and a cycle timer connected in said electric circuit and being started by said thermostat at said temperature, the cycle timer disconnecting the heating cables from said current supply after a chosen time period.

10. A device according to claim 9, comprising a lead-in socket to be sealingly placed in a downpipe from said gully, to carry a current supply cable of said electric circuit forwards to said heating cable via the downpipe, the supply cable being carried through a hole in the wall of said downpipe at the lower end of said socket, and the socket being provided with a sealing means preventing water leakage from said downpipe via said hole.

11. A device according to claim 10, wherein said socket consists of a cylindrical tube length having a diameter which is somewhat smaller than the diameter of said downpipe, the wall of the socket being provided with at least one ring groove for receiving a sealing ring for sealing against said downpipe, and wherein said socket at its lower end is provided with a chute-shaped recess for receiving a portion of the current supply cable extending a distance downwards from said hole.

12. A device according to claim 11, wherein said socket above said recess is provided with a combined guiding and fastening means for a protecting tube for said current supply cable, so that the protecting tube may be moved onto the cable and by means of said guiding means may be displaced downwards until it stops against the supply cable where this is bent upwards from said recess at the lower end of said socket.

13. A device according to claim 12, wherein said guiding means consists of a guide rail for slidable engagement in a corresponding guide channel fastened to said protecting tube.

* * * * *